US011236645B2

(12) United States Patent
Yamamoto

(10) Patent No.: US 11,236,645 B2
(45) Date of Patent: Feb. 1, 2022

(54) VALVE TIMING CONTROLLER

(71) Applicant: AISIN SEIKI KABUSHIKI KAISHA, Kariya (JP)

(72) Inventor: Atsushi Yamamoto, Kariya (JP)

(73) Assignee: AISIN CORPORATION, Kariya (JP)

( * ) Notice: Subject to any disclaimer, the term of this patent is extended or adjusted under 35 U.S.C. 154(b) by 0 days.

(21) Appl. No.: 17/197,233

(22) Filed: Mar. 10, 2021

(65) Prior Publication Data

US 2021/0317762 A1 Oct. 14, 2021

(30) Foreign Application Priority Data

Apr. 14, 2020 (JP) ..... JP2020-072305

(51) Int. Cl.
*F01L 1/352* (2006.01)
*F01L 13/00* (2006.01)

(52) U.S. Cl.
CPC ..... *F01L 1/352* (2013.01); *F01L 2013/103* (2013.01); *F01L 2013/116* (2013.01); *F01L 2201/00* (2013.01); *F01L 2820/032* (2013.01); *F01L 2820/044* (2013.01)

(58) Field of Classification Search
CPC ..... F01L 1/352; F01L 1/46; F01L 2013/103; F01L 2013/116; F01L 2201/00; F01L 2820/032; F01L 2820/044
USPC ..... 123/90.15
See application file for complete search history.

(56) References Cited

U.S. PATENT DOCUMENTS 8,089,235 B2 * 1/2012 Morino ..... H02P 7/285 318/432
2005/0076867 A1 * 4/2005 Tani ..... F01L 13/0042 123/90.17
2007/0200523 A1 8/2007 Sasaki et al.
2008/0051980 A1 * 2/2008 Mizuno ..... F01L 1/022 701/105
2009/0121671 A1 * 5/2009 Uehama ..... F01L 1/352 318/809
2011/0290205 A1 * 12/2011 Kozawa ..... F01L 1/352 123/90.17

(Continued)

FOREIGN PATENT DOCUMENTS

JP 2007228768 A 9/2007

*Primary Examiner* — Jorge L Leon, Jr.
(74) *Attorney, Agent, or Firm* — Buchanan Ingersoll & Rooney PC

(57) ABSTRACT

A valve timing controller includes: a driving-side rotation member synchronously rotating with respect to a crankshaft of an internal combustion engine; a driven-side rotation member disposed coaxially with a rotation axis of the driving-side rotation member, and rotating integrally with a camshaft of the engine; a phase setting mechanism setting a relative rotation phase between the driving-side and driven-side rotation members; a brushless motor driving the phase setting mechanism; a control portion controlling the brushless motor by electrifying an inverter having three sets of arm portions having high-side and low-side switching elements connected to each other in series between a first power supply line and a second power supply line connected to a potential lower than a potential of the first power supply line; and a command information acquisition section acquiring holding command information indicating a command for holding a rotor of the brushless motor in a non-rotating state.

5 Claims, 6 Drawing Sheets

(56) References Cited

U.S. PATENT DOCUMENTS

2016/0215662 A1* 7/2016 Sato ..... F01L 1/352

* cited by examiner

VALVE TIMING CONTROLLER

CROSS REFERENCE TO RELATED APPLICATIONS

This application is based on and claims priority under 35 U.S.C. § 119 to Japanese Patent Application 2020-072305, filed on Apr. 14, 2020, the entire content of which is incorporated herein by reference.

TECHNICAL FIELD

This disclosure relates to a valve timing controller that controls a valve opening and closing timing of an internal combustion engine by a driving force of a brushless motor.

BACKGROUND DISCUSSION

In the related art, a valve timing controller capable of changing the opening and closing timing of an intake valve or an exhaust valve according to an operating condition of an internal combustion engine (hereinafter, also referred to as "engine") has been used. The valve timing controller has a mechanism to change the opening and closing timing of the intake valve or the exhaust valve by changing the relative rotation phase (hereinafter, also simply referred to as "relative rotation phase") of a driven-side rotation member with respect to the rotation of a driving-side rotation member due to the operation of the engine. In recent years, idling stop control for temporarily stopping the engine, for example, when stopping the vehicle by stepping a brake pedal during the normal operation has been put into practical use. In a case where the restart is quick, such as when the idling is stopped, the valve timing controller needs to keep the relative rotation phase at the most retarded angle in order to reduce the load on the engine and prepare for the restart. However, it is not easy to maintain the relative rotation phase at the most retarded angle due to an external force such as pressure in the cylinder acting on a camshaft when restarting the engine that has stopped idling. Therefore, it is considered to lock the motor when the engine is restarted. As a technique used to lock such a motor, for example, there is a technique described in JP 2007-228768A (Reference 1) of which a source is illustrated below.

Reference 1 discloses a motor drive unit. The motor drive unit drives a three-phase brushless motor by controlling a switching circuit having a plurality of switching elements that electrify the three-phase winding. When the brushless motor is locked, the winding is electrified such that only one phase of the switching circuit performs PWM control.

In the technique described in Reference 1, only one phase of the switching circuit performs the PWM control, a current flows mainly through a specific element and winding during this electrification control. Therefore, there is a possibility that the temperature of a specific element rises, and the element deteriorates or is damaged.

A need thus exists for a valve timing controller which is not susceptible to the drawback mentioned above.

SUMMARY

A feature of a valve timing controller according to an aspect of this disclosure resides in that the valve timing controller includes: a driving-side rotation member that synchronously rotates with respect to a crankshaft of an internal combustion engine; a driven-side rotation member that is disposed coaxially with a rotation axis of the driving-side rotation member, and rotates integrally with a camshaft of the internal combustion engine; a phase setting mechanism that sets a relative rotation phase between the driving-side rotation member and the driven-side rotation member; a brushless motor that drives the phase setting mechanism; a control portion that controls the brushless motor by electrifying an inverter having three sets of arm portions having a high-side switching element and a low-side switching element connected to each other in series between a first power supply line and a second power supply line connected to a potential lower than a potential of the first power supply line; and a command information acquisition section that acquires holding command information indicating a command for holding a rotor of the brushless motor in a non-rotating state, in which the control portion controls the brushless motor in a first electrification mode including a first electrified state and a second electrified state, in a case where the command information acquisition section acquires the holding command information, the first electrified state is a state where both the high-side switching element of one arm portion among the three sets of arm portions and the low-side switching element of any one of the remaining two arm portions among the three sets of arm portions are closed, and the second electrified state is a state where the high-side switching element of the one arm portion among the three sets of arm portions is closed.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A valve timing controller according to the present disclosure is configured to suppress deterioration or damage of the element even in a case where the brushless motor is locked. Hereinafter, a valve timing controller 100 of this embodiment will be described.

Figure 1:
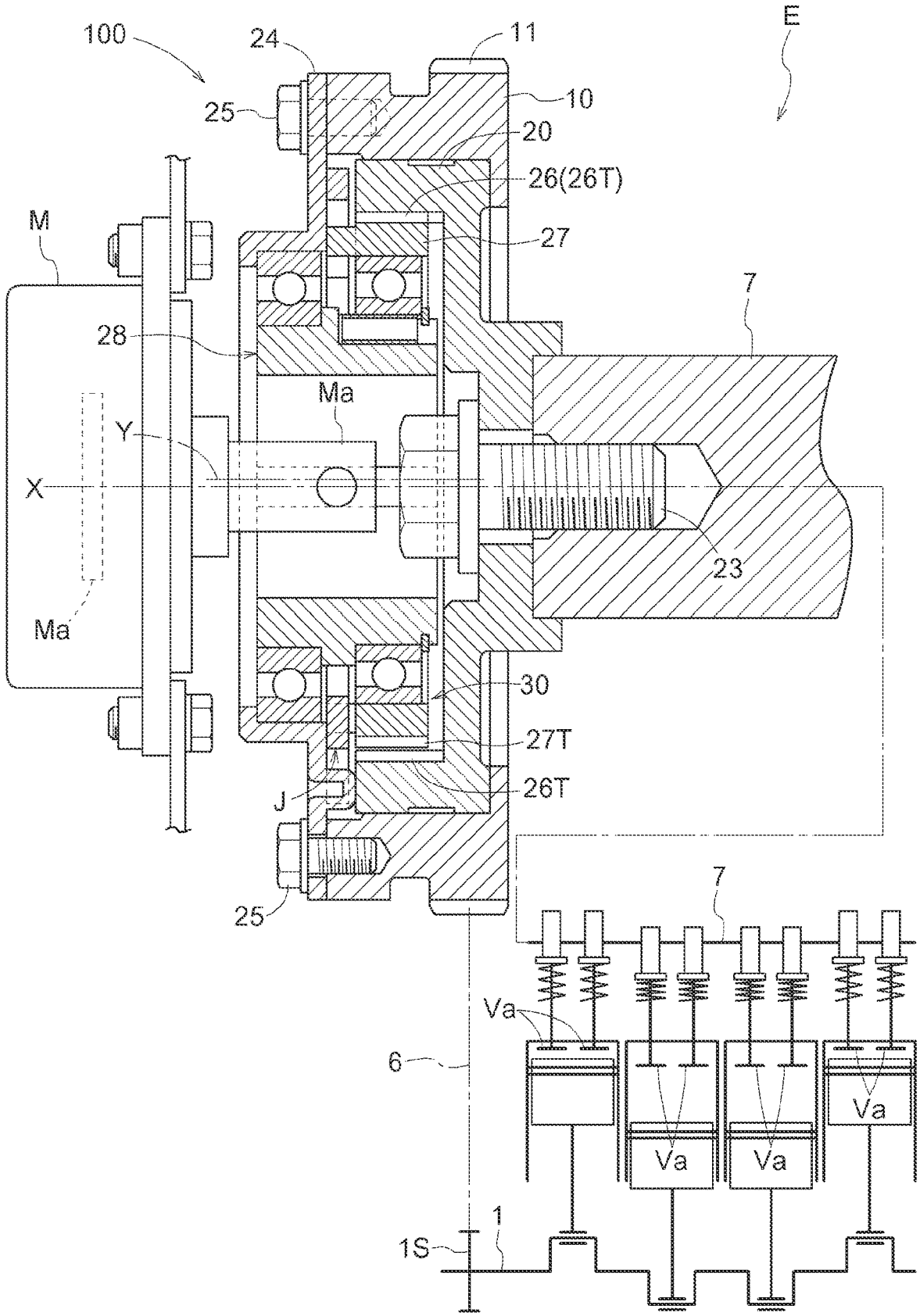
FIG. 1 is a sectional view of a valve timing controller.
Figure 2:
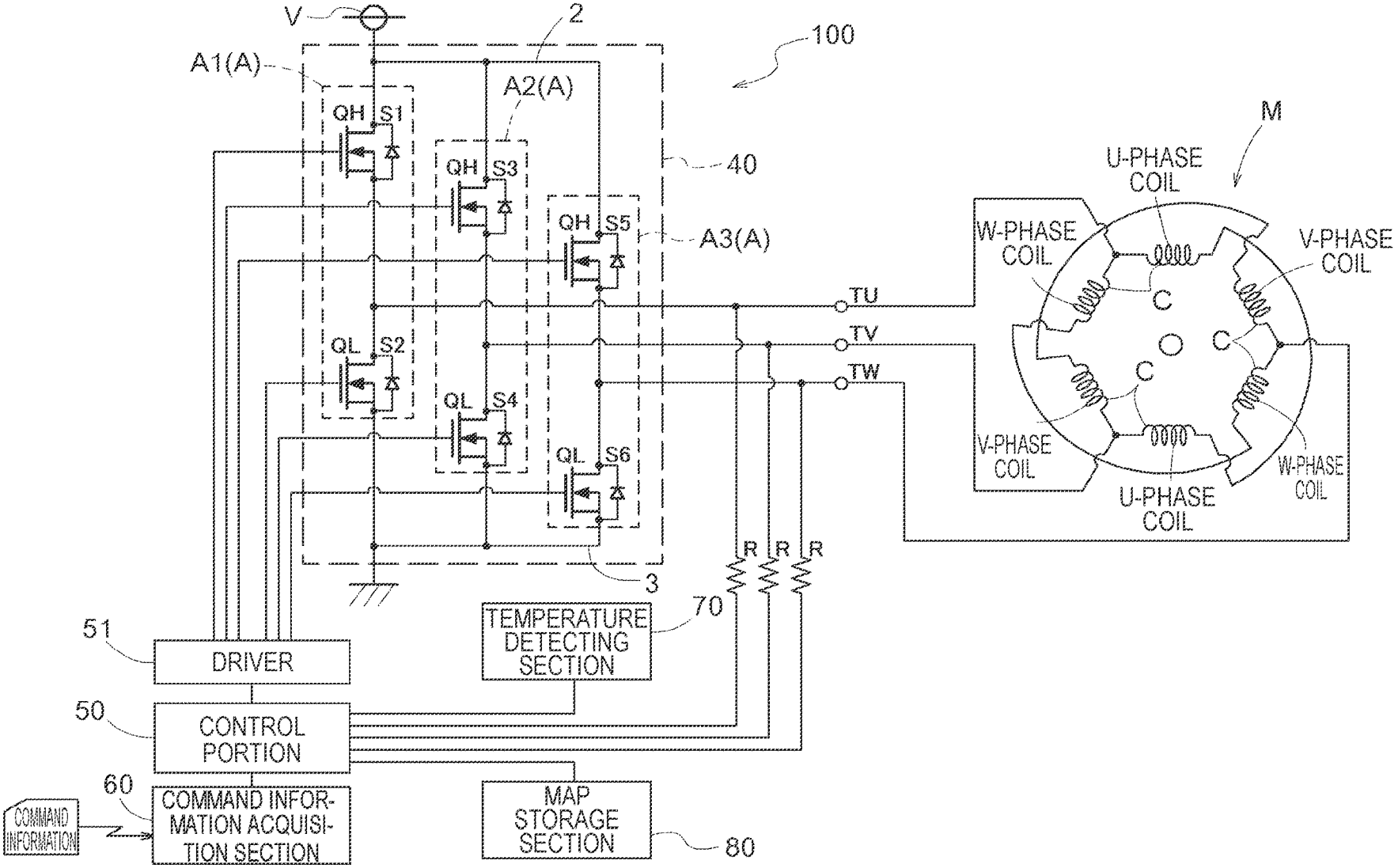
FIG. 2 is a view illustrating a configuration of a motor and an inverter.

FIG. 1 is a sectional view of a valve timing controller 100, and FIG. 2 illustrates a configuration of a brushless motor (hereinafter, referred to as "motor") M of the valve timing controller 100 and an inverter 40 for driving the motor M. As illustrated in FIGS. 1 and 2, the valve timing controller 100 includes a driving case (an example of a "driving-side rotation member") 10, an internal rotor (an example of a "driven-side rotation member") 20, a phase setting mechanism 30, the motor M, the inverter 40, a control portion 50, a command information acquisition section 60, a temperature detecting section 70, and a map storage section 80. In particular, the control portion 50, the command information acquisition section 60, and the map storage section 80 are constructed with hardware, software, or both the hardware and the software with a CPU as a core member in order to perform processing related to suppression of deterioration or damage of elements.

The driving case 10 rotates synchronously with respect to a crankshaft 1 of an internal combustion engine E. The internal combustion engine E has an intake valve Va of which the opening and closing timing is controlled by the valve timing controller 100. The crankshaft 1 corresponds to an output shaft that outputs a rotational force from the internal combustion engine E. A drive pulley 11 is provided on the outer peripheral surface of the driving case 10, and a timing belt 6 is wound around an output pulley 1S of the crankshaft 1. Accordingly, the driving case 10 can rotate synchronously with respect to the crankshaft 1.

The internal rotor 20 is disposed coaxially with the rotation axis X of the driving case 10 and rotates integrally with an intake camshaft 7 (in this embodiment, the camshaft for the intake valve Va) of the internal combustion engine E. Being disposed coaxially with the rotation axis of the driving case 10 means being disposed in a state where the axis of the internal rotor 20 is coincident to the axis of the driving case 10. The internal rotor 20 is included in the driving case 10 and is connected and fixed to the intake camshaft 7 by a connecting bolt 23. Accordingly, the internal rotor 20 is supported by the intake camshaft 7 in a connected state, and the driving case 10 is supported at the outer peripheral part of the internal rotor 20 so as to be relatively rotatable.

The phase setting mechanism 30 sets the relative rotation phase between the driving case 10 and the internal rotor 20. The phase setting mechanism 30 is driven by the motor M, and the phase setting mechanism 30 is housed in the driving case 10 together with the internal rotor 20. In the driving case 10, a front plate 24 is fastened and fixed to the opening part by a plurality of fastening bolts 25. Accordingly, the displacement of the phase setting mechanism 30 and the internal rotor 20 in the direction along the rotation axis X is restricted by the front plate 24.

As described above, the driving case 10 and the internal rotor 20 are rotated clockwise by the driving force from the timing belt 6. The driving force of the motor M is transmitted to the internal rotor 20 via the phase setting mechanism 30, and the relative rotation phase of the internal rotor 20 with respect to the driving case 10 is displaced. Of these displacements, the displacement direction toward the same direction as the rotation direction (clockwise direction) due to the driving force from the timing belt 6 is referred to as the advancing direction, and the opposite direction thereof is referred to as the retarding direction.

The phase setting mechanism 30 includes a ring gear 26 formed coaxially with the rotation axis X at the inner periphery of the internal rotor 20, an inner gear 27 rotatably disposed coaxially with an eccentric center axis Y on the inner peripheral side of the internal rotor 20, an eccentric cam body 28 disposed on the inner peripheral side of the inner gear 27, the front plate 24, and a connector portion J. The eccentric center axis Y is formed in a posture parallel to the rotation axis X.

The ring gear 26 has a plurality of internal teeth portions 26T, and the inner gear 27 has a plurality of external teeth portions 27T. A part of the external teeth portion 27T is interlocked with the internal teeth portion 26T of the ring gear 26. The phase setting mechanism 30 is configured as a planetary gear reducer in which the number of teeth of the external teeth portion 27T of the inner gear 27 is smaller by one than the number of teeth of the internal teeth portion 26T of the ring gear 26.

In this embodiment, when the internal combustion engine E is in operation, an output shaft Ma is driven and rotated clockwise at the same speed as that of the crankshaft 1, and accordingly, the relative rotation phase between the driving case 10 and the internal rotor 20 is maintained. In a case where the relative rotation phase is displaced in the advancing direction, the rotation speed of the output shaft Ma is controlled to be reduced, and in a case where the relative rotation phase is displaced in the retarding direction, the rotation speed of the output shaft Ma is controlled to be increased.

In other words, in the phase setting mechanism 30, when the eccentric cam body 28 rotates around the rotation axis X with the rotation of the output shaft Ma driven by the motor M, every time the inner gear 27 rotates once, the inner gear 27 and the ring gear 26 are relatively rotated by an angle corresponding to the difference in the number of teeth. As a result, it is possible to adjust the valve timing by relatively rotating the driving case 10 that integrally rotates with the inner gear 27 via the connector portion J and the intake camshaft 7 connected to the ring gear 26 by the connecting bolt 23.

The control portion 50 electrifies the inverter 40 to control the motor M. The electrification of the inverter 40 switches the electrified state of a coil C based on the position of the rotor (not illustrated) of the motor M. The position of the rotor is the position (rotation angle) of the rotor that rotates in response to the electrification with respect to the coil C of the motor M. Switching the electrified state of the coil C means that switching to a state where a current flows from a U-phase terminal TU to a V-phase terminal TV, a state where a current flows from the U-phase terminal TU to a W-phase terminal TW, a state where a current flows from the V-phase terminal TV to the W-phase terminal TW, a state where a current flows from the V-phase terminal TV to the U-phase terminal TU, a state where a current flows from the W-phase terminal TW to the U-phase terminal TU, and a state where a current flows from the W-phase terminal TW to the V-phase terminal TV, is performed in order. The control portion 50 generates a PWM signal and PWM-controls the inverter 40 described later. Accordingly, it is possible to control the electrification with respect to the coil C of the motor M. Since the PWM control by such a PWM signal is known, the description thereof will be omitted.

A driver 51 is provided between the control portion 50 and the inverter 40, and the PWM signal generated by the control portion 50 is input into the driver 51. The driver 51 improves the drive capability of the input PWM signal and outputs the PWM signal to the inverter 40.

The inverter 40 controls the current passing through the coil C of the motor M. The inverter 40 has three sets of arm portions A having a high-side switching element QH and a low-side switching element QL connected to each other in series between a first power supply line 2 and a second power supply line 3 connected to a potential lower than a potential of the first power supply line 2. The first power supply line 2 is a cable connected to a power supply V. The second power supply line 3 connected to a lower potential than a potential of the first power supply line 2, is a cable to which the potential lower than the output voltage of the power supply V is applied, and corresponds to a cable which is grounded in this embodiment.

In this embodiment, the high-side switching element QH and the low-side switching element QL are configured by using N-MOSFET. In the high-side switching element QH, a drain terminal is connected to the first power supply line 2, and a source terminal is connected to the drain terminal of the low-side switching element QL. The source terminal of the low-side switching element QL is connected to the second power supply line 3. The high-side switching element QH and the low-side switching element QL connected in this manner form the arm portion A, and the inverter 40 includes three sets of the arm portions A.

Each gate terminal of the high-side switching element QH and the low-side switching element QL is connected to the driver 51, and the above-described PWM signal with improved drive capability is input. The source terminals of the high-side switching element QH of each arm portion A are connected to three terminals (U-phase terminal TU, V-phase terminal TV, W-phase terminal TW) of the motor M, respectively.

Here, in order to make it easy to understand, the high-side switching element QH of which the source terminal is directly connected to the U-phase terminal TU is set as a switch S1, and the low-side switching element QL of which the drain terminal is directly connected to the U-phase terminal TU is set as a switch S2. The arm portion A having the switch S1 and the switch S2 is referred to as a first arm portion A1. The high-side switching element QH of which the source terminal is directly connected to the V-phase terminal TV is set as a switch S3, and the low-side switching element QL of which the drain terminal is directly connected to the V-phase terminal TV is set as a switch S4. The arm portion A having the switch S3 and the switch S4 is referred to as a second arm portion A2. The high-side switching element QH of which the source terminal is directly connected to the W-phase terminal TW is set as a switch S5, and the low-side switching element QL of which the drain terminal is directly connected to the W-phase terminal TW is set as a switch S6. The arm portion A having the switch S5 and the switch S6 is referred to as a third arm portion A3.

Figure 3:
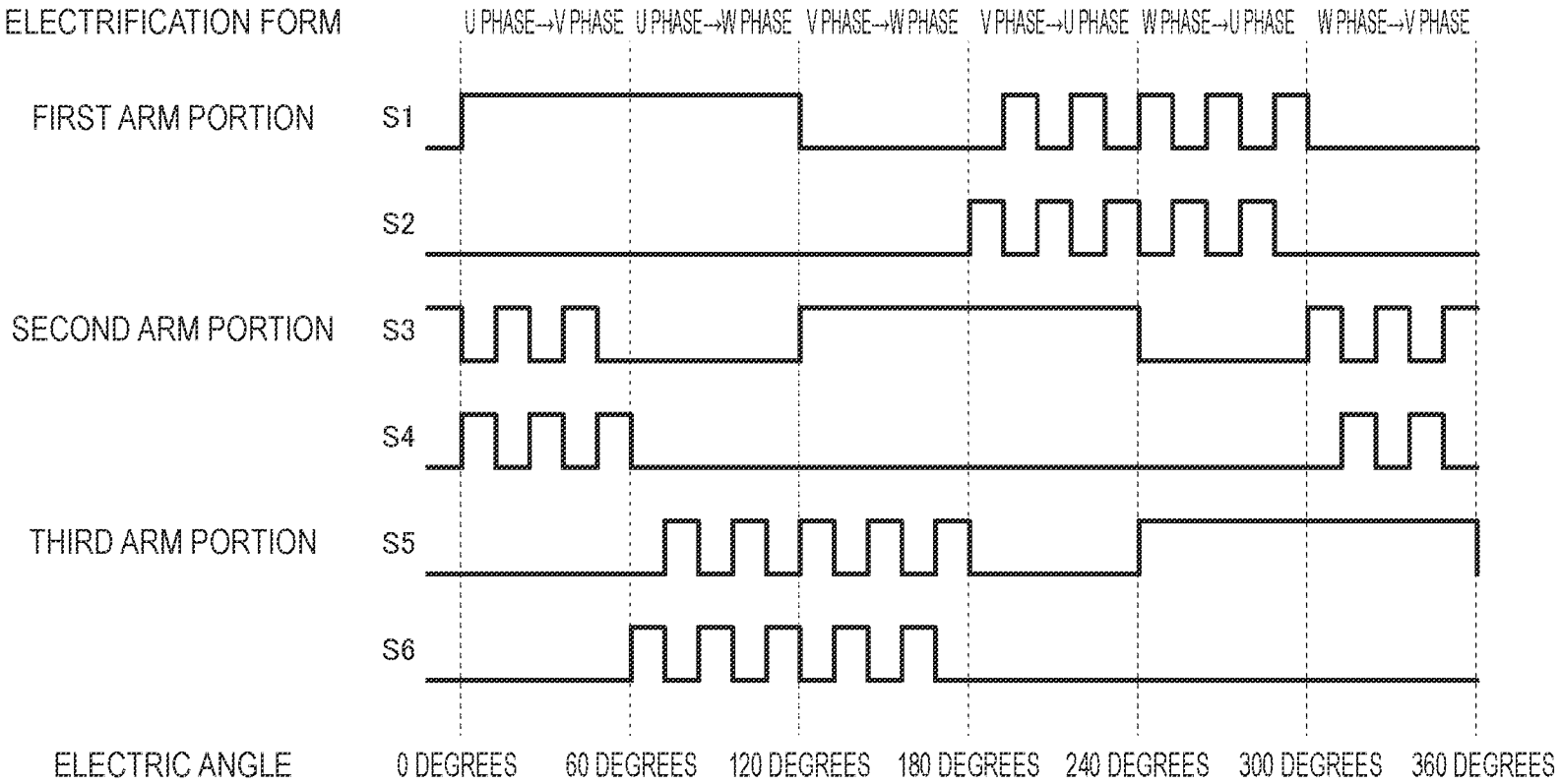
FIG. 3 is a time chart illustrating an open/closed state of a switching element.

FIG. 3 illustrates a control signal input from the control portion 50 to each gate terminal of each of the switch S1 to the switch S6. Accordingly, it is possible for the rotor of the motor M to rotate appropriately and maintain the relative rotation phase. As described above, in a case where the relative rotation phase is changed, it is realized by adjusting the on-duty time of each part in FIG. 3. In FIG. 3, in a case where a current flows from the U-phase terminal TU to the V-phase terminal TV, "U-phase→V-phase" is described as an electrification form, but other electrification forms are also the same. The control portion 50 detects the current value of the current flowing through the coil C of the motor M via a shunt resistor R (corresponding to a current detecting section), and controls the motor M by feedback control based on the current value and the command information acquired by the command information acquisition section 60.

The command information acquisition section 60 acquires the command information including the rotation speed required for the motor M and the output torque required for the motor M. The command information is transmitted from, for example, a host system (a management system that manages the entire operation of the valve timing controller 100). The command information is transmitted to the control portion 50, and the control portion 50 performs the above-described feedback control.

For example, when the internal combustion engine E is restarted after idling is stopped, there is a case where it is desired to maintain the relative rotation phase at the most retarded angle, that is, a case where it is desired to lock the motor M when the internal combustion engine E is restarted. In such a case, the command information acquisition section 60 acquires holding command information indicating a command for holding the motor M in a non-rotating state as command information. Such holding command information is also transmitted from the above-described host system. When the command information acquisition section 60 acquires the holding command information, the holding command information is transmitted to the control portion 50.

Figure 4:
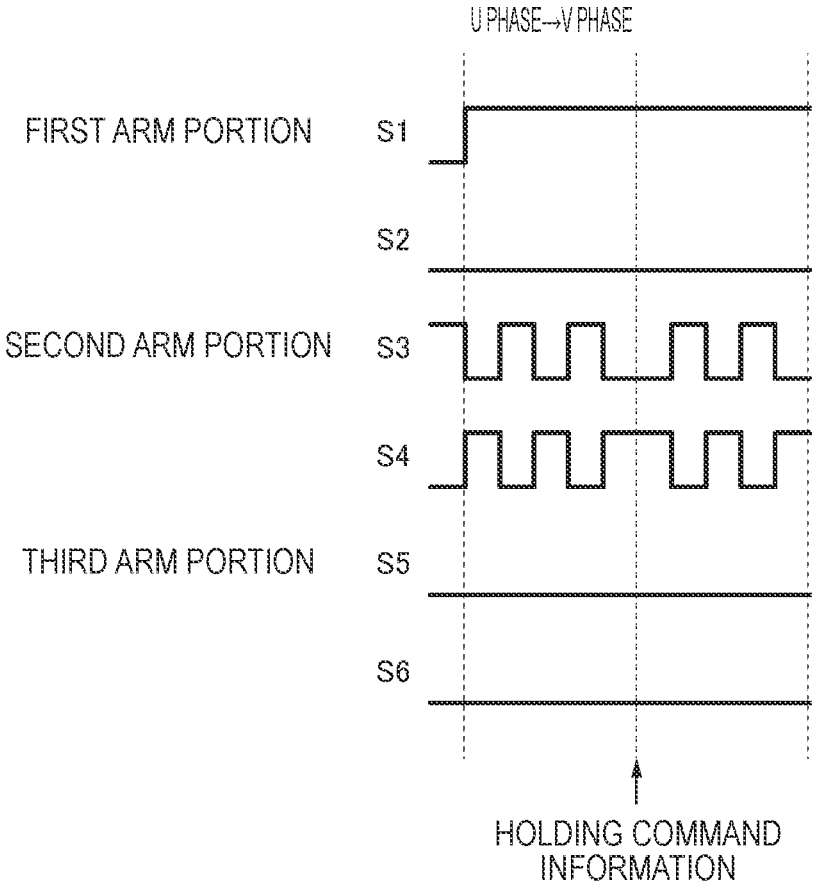
FIG. 4 is a time chart illustrating the open/closed state of the switching element in a first electrification mode.

In a case where the command information acquisition section 60 has acquired the holding command information, the control portion 50 controls the motor M in a first electrification mode including a first electrified state and a second electrified state. The first electrification mode is a mode in which a predetermined one phase is electrified. FIG. 4 illustrates control signals input into the respective gate terminals of the switch S1 to the switch S6 in the first electrification mode. FIG. 4 illustrates an example in which the holding command information is acquired when the electrification form is in the "U phase→V phase" state.

The first electrified state is a state where both the high-side switching element QH of one arm portion A among the three sets of arm portions A and the low-side switching element QL of one of the remaining two arm portions A among the three sets of arm portions A are closed. In this embodiment, in order to make it easy to understand, the high-side switching element QH of the one arm portion A among the three sets of arm portions A is described as the switch S1. The low-side switching element QL of one of the remaining two arm portions A among the three sets of arm portions A is described as the switch S4. Here, a state of being closed means a state where there is at least a closed state in one cycle in the PWM control, and means a state where there is no open state over the one cycle. In this first electrified state, the current via the switch S1, the U-phase terminal TU, the U-phase coil C, the V-phase terminal TV, and the switch S4, and the current via the switch S1, the U-phase terminal TU, the W-phase coil C, the V-phase coil C, the V-phase terminal TV, and the switch S4 flow.

The second electrified state is a state where the high-side switching element QH of the one arm portion A among the three sets of arm portions A is closed. In this embodiment, the high-side switching element QH of one of the remaining two arm portions A among the three sets of arm portions A is also closed. In this embodiment, as described above, the high-side switching element QH of the one arm portion A among the three sets of arm portions A is the switch S1, and the high-side switching element QH of one of the remaining two arm portions A among the three sets of arm portions A is the switch S3. A state of being closed means a state where there is at least a closed state in one cycle in the PWM control as described above, and means a state where there is no open state over the one cycle. In this second electrified state, due to the current flowing through each coil C in the first electrified state, the current via the switch S1, the U-phase terminal TU, the U-phase coil C, the V-phase terminal TV, and the switch S3, and the current via the switch S1, the U-phase terminal TU, the W-phase coil C, the V-phase coil C, the V-phase terminal TV, and the switch S3 flow.

In the example of FIG. 4, a form in which the first electrification mode is performed over one cycle after the holding command information is provided is illustrated. The first electrification mode may be completed in one cycle, or may be configured to be repeated over two or more cycles.

In such a first electrification mode, the motor M can be electrified without rotating the rotor of the motor M, and thus, the output torque can be generated without rotating the motor M. Therefore, when the internal combustion engine E is restarted after the idling is stopped, the relative rotation phase can be maintained at the most retarded angle.

Figure 5:
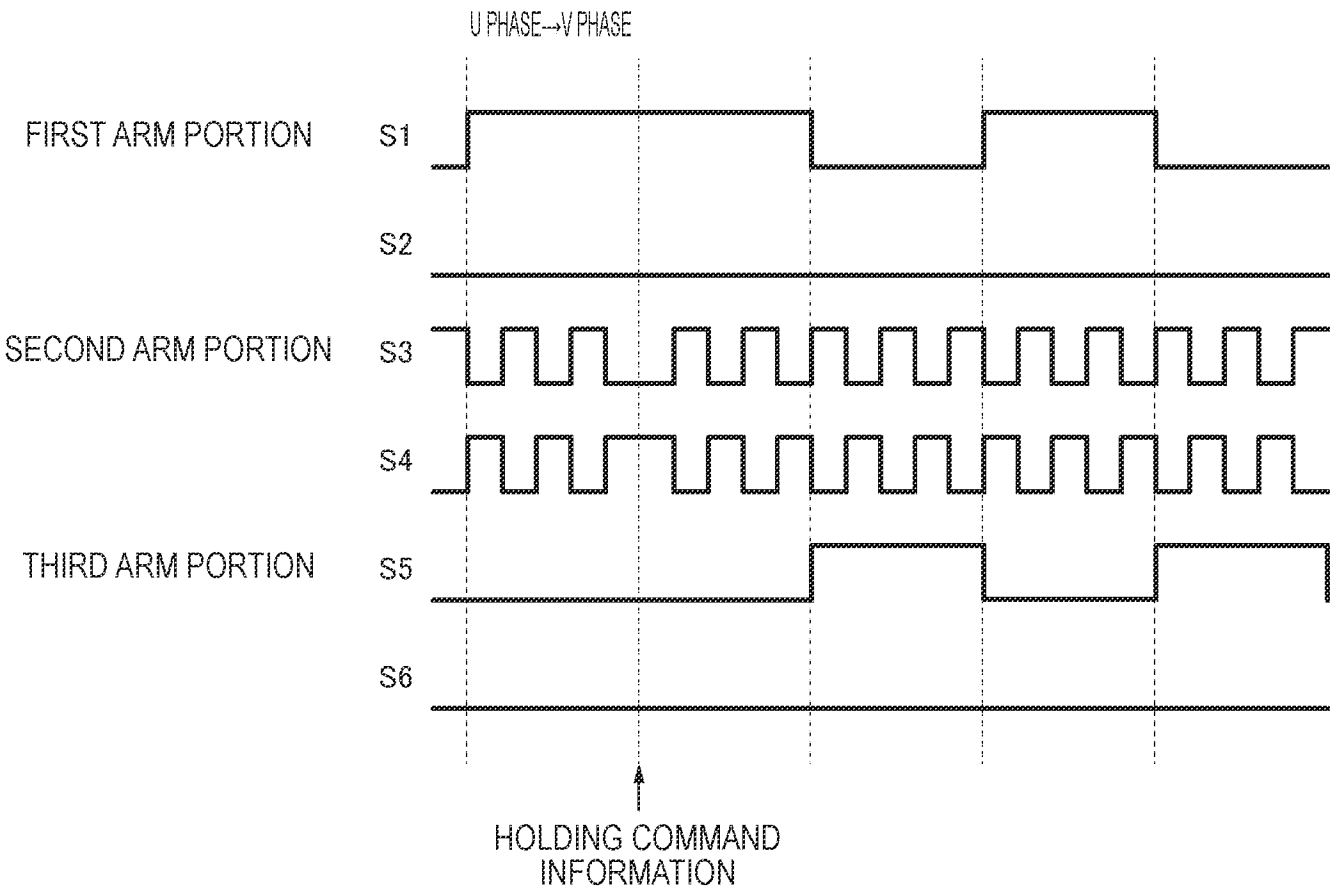
FIG. 5 is a time chart illustrating the open/closed state of the switching element in a second electrification mode.

In this embodiment, in a case where the preset switching condition is satisfied, the control portion 50 is configured to switch from the first electrification mode to the second electrification mode including the third electrified state and the fourth electrified state, and to control the motor M. The preset switching condition is a condition for switching the control form of the motor M from the first electrification mode to the second electrification mode different from the first electrification mode (the switching condition will be described later). The first electrification mode is a form in which the motor M is controlled by the pattern illustrated in FIG. 4 described above. The second electrification mode is a mode (60-degree retarded angle electrification) in which electrification is performed by a so-called "60-degree retarded angle" in which the electric angle is advanced by 60 degrees with respect to the electrification form according to the first electrification mode. FIG. 5 illustrates control signals input into the respective gate terminals of the switch S1 to the switch S6 in the second electrification mode. FIG. 5 illustrates an example in which the first electrification mode and the second electrification mode are alternately switched after the holding command information is received.

The third electrified state is a state where both the high-side switching element QH of the one arm portion A among the three sets of arm portions A and the low-side switching element QL of the other one of the remaining two arm portions A among the three sets of arm portions A are closed. The high-side switching element QH of the one arm portion A among the three sets of arm portions A is the switch S5 in this embodiment. The low-side switching element QL of the other one of the remaining two arm portions A among the three sets of arm portions A is the switch S4 in this embodiment. Here, even in the third electrified state, the state of being closed means a state where there is at least a closed state in one cycle in the PWM control, and means there is no open state over the one cycle. In this third electrified state, the current via the switch S5, the W-phase terminal TW, the V-phase coil C, the V-phase terminal TV, and the switch S4, and the current via the switch S5, the W-phase terminal TW, the W-phase coil C, the U-phase coil C, the V-phase terminal TV, and the switch S4 flow.

The fourth electrified state is a state where the high-side switching element QH of one arm portion A among the three sets of arm portions A is closed. In this embodiment, the high-side switching element QH of the other one of the remaining two arm portions A among the three sets of arm portions A is also closed. In this embodiment, the high-side switching element QH of the one arm portion A among the three sets of arm portions A is the switch S5, and the high-side switching element QH of the other one of the remaining two arm portions A among the three sets of arm portions A is the switch S3. A state of being closed means a state where there is at least a closed state in one cycle in the PWM control as described above, and means a state where there is no open state over the one cycle. In this fourth electrified state, all the low-side switching elements QL of the three sets of arm portions A are opened. Therefore, due to the current that has flowed through each coil C in the third electrified state, the current via the switch S5, the W-phase terminal TW, the V-phase coil C, the V-phase terminal TV, and the switch S3, and the current via the switch S5, the W-phase terminal TW, the W-phase coil C, the U-phase coil C, the V-phase terminal TV, and the switch S3 flow.

In such a second electrification mode, each coil C can be electrified without rotating the rotor of the motor M, and thus, the output torque can be generated without rotating the motor M. In the valve timing controller 100, when the internal combustion engine E is restarted after the idling is stopped, there is a case where the relative rotation phase is maintained at the most retarded angle. In such a case, in order to keep the relative rotation phase at the most retarded angle, the relative rotation phase is held at the most retarded angle by passing a current through the optimum one phase among the three phases of the motor M. For example, when a current is passed only through specific one phase, the heat generation at the specific one phase becomes large, but according to the valve timing controller 100, a current is also passed through another one phase, and thus, it is possible to disperse the heat. By passing a current through another one phase, heat generation can be suppressed, and it is possible to maintain the relative rotation phase at the desired phase. In the example of FIG. 5, the fourth electrified state and the third electrified state are illustrated in this order.

Here, the above-described preset switching condition for the control portion 50 to switch from the first electrification mode to the second electrification mode will be described. For example, it is preferable that the control portion 50 is configured to switch to the second electrification mode to control the inverter 40 in a case where the ambient temperature exceeds a preset temperature during the control of the motor M in the first electrification mode. A state during the control of the motor M in the first electrification mode means a state where the motor M is electrified in the pattern illustrated in FIG. 4 in this embodiment. The ambient temperature is the ambient temperature of at least one of the inverter 40, the coil C of the motor M, and the motor M.

The ambient temperature may be detected by the temperature detecting section 70. The temperature detecting section 70 can be configured by using, for example, a thermistor of which the resistance value changes depending on the temperature on the substrate on which each of the switching elements QH and QL of the inverter 40 is mounted. Since temperature detection using such a thermistor is known, the description thereof will be omitted. The temperature detecting section 70 may be configured to detect the ambient temperature by a method other than the thermistor. The temperature of the coil C of the motor M or the motor M can also be detected by using a known thermistor or sensor.

It is preferable that the control portion 50 is configured to acquire the detection result of the temperature detecting section 70, and switch to the second electrification mode in a case where the detection results (the ambient temperature of at least one of the inverter 40, the coil C of the motor M, and the motor M) in the first electrification mode exceeds the preset temperature.

The control portion 50 can also be configured to switch between the first electrification mode and the second electrification mode based on the temperature estimation map to control the motor M instead of the switching by the ambient temperature or in combination with the switching by the ambient temperature. The temperature estimation map is a map for estimating the temperature of at least one of the inverter 40, the coil C of the motor M, and the motor M, which is defined by the current value of the electrifying current for the motor M and the time for electrifying the motor M with the electrifying current. The current value of the electrifying current that electrifies the motor M may be a current value of the current output from the inverter 40 or a current value of the current flowing through the coil C of the motor M. This current value may be an average value of the electrifying current or an effective value. The time for electrifying the motor with the electrifying current is the time for which the electrifying current having the above-described current value is output from the inverter 40 or the time for which the electrifying current flows through the coil C of the motor M. It is preferable that such a temperature estimation map is stored in advance in the map storage section 80, and the control portion 50 integrates the temperature rises while calculating the temperature rises of the switching elements QH and QL of the inverter 40 or the coil C of the motor M with reference to the temperature estimation map, and switches from the first electrification mode to the second electrification mode in a case where the integrated value reaches a predetermined value.

After switching from the first electrification mode to the second electrification mode, the control portion 50 may switch from the second electrification mode to the first electrification mode to control the motor M based on the ambient temperature of the inverter 40 and the temperature of the inverter 40 estimated by the temperature estimation map, and further, may alternately switch between the first electrification mode and the second electrification mode to control the motor M.

Here, the control portion 50 may control the motor M such that the electrifying current that electrifies the motor M in the second electrification mode becomes larger than the electrifying current that electrifies the motor M in the first electrification mode, and the time for electrifying the motor M with the electrifying current in the second electrification mode is shorter than the time for electrifying the motor M with the electrifying current in the first electrification mode. Specifically, when assuming that the electrifying current for electrifying the motor M in the second electrification mode is 5 A, the electrifying current for electrifying the motor M in the first electrification mode may be less than 5 A (for example, 3 A), and when assuming that the time for electrifying the motor M with the electrifying current in the first electrification mode is 0.5 seconds, the time for electrifying the motor M with the electrifying current in the second electrification mode may be less than 0.5 seconds (for example, 0.3 seconds).

Figure 6A:
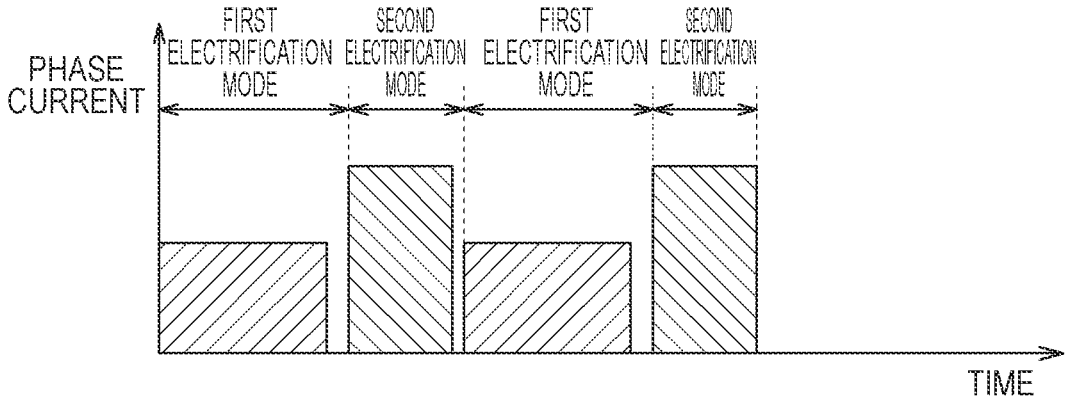
FIGS. 6A and 6B are explanatory views of a temperature change.
Figure 6B:
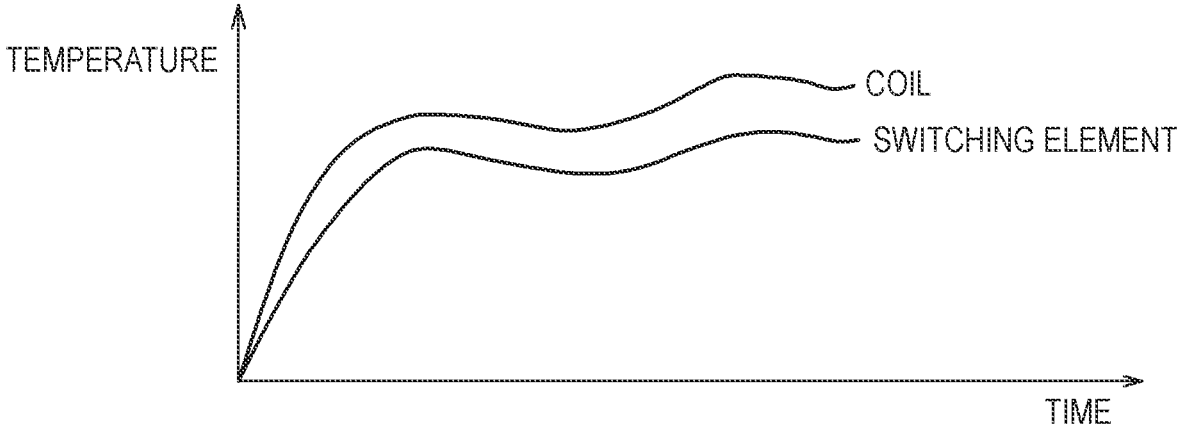

The valve timing controller 100 is configured as described above, and as illustrated in FIG. 6A, the control portion 50 controls the current (phase current) flowing to the motor M in the first electrification mode and the second electrification mode, and repeats the first phase electrification in the first electrification mode and the 60-degree advanced angle electrification in the second electrification mode, and accordingly, it is possible to present unipolar concentration of the current in the electrification phase of the coil C of the motor M and the switching elements QH and QL, and to suppress the temperature rises of the coil C of the motor M and the switching elements QH and QL of the inverter 40 as illustrated in FIG. 6B. Therefore, it is possible to suppress the deterioration of the element.

OTHER EMBODIMENTS

In the above-described embodiment, an example in which the valve timing controller 100 controls the opening and closing timing of the intake valve Va has been described, but the valve timing controller 100 may be configured to control the opening and closing timing of an exhaust valve, or may be configured to control the opening and closing timing of both the intake valve Va and the exhaust valve.

In the above-described embodiment, in a case where the preset switching condition is satisfied, the control portion 50 switches from the first electrification mode to the second electrification mode to control the motor M, but the control portion 50 can also be configured to control the motor M only in the first electrification mode without switching from the first electrification mode to the second electrification mode.

In the above-described embodiment, a case where the valve timing controller 100 includes the temperature detecting section 70 that detects the ambient temperature of at least one of the inverter 40, the coil C of the motor M, and the motor M is described, but it is also possible to configure the valve timing controller 100 without the temperature detecting section 70.

In the above-described embodiment, a case where the valve timing controller 100 includes the map storage section 80 that stores the temperature estimation map for estimating the temperature of the inverter 40, which is defined by the current value of the electrifying current for the motor M, and the time for electrifying the electrifying current is described, but it is also possible to configure the valve timing controller 100 without the map storage section 80.

In the configuration including both the temperature detecting section 70 and the map storage section 80, in a case where any of the ambient temperature of at least one of the inverter 40, the coil C of the motor M, and the motor M, which is detected by the temperature detecting section 70, and the temperature of at least any one of the inverter 40, the coil C of the motor M, and the motor M, which is estimated by the temperature estimation map stored in the map storage section 80, reaches a reference temperature (threshold value), it is also possible to configure the control portion 50 to switch from the first electrification mode to the second electrification mode to control the motor M. In such a case, the second electrification mode may be switched to the first electrification mode.

In the above-described embodiment, a case where the electrifying current that electrifies the motor M in the second electrification mode becomes larger than the electrifying current that electrifies the motor M in the first electrification mode, and the time for electrifying the motor M with the electrifying current in the second electrification mode is shorter than the time for electrifying the motor M with the electrifying current in the first electrification mode is described, but the electrifying current that electrifies the motor M in the second electrification mode may be equivalent to or smaller than the electrifying current that electrifies the motor M in the first electrification mode. The time for electrifying the motor M with the electrifying current in the second electrification mode may be equal to or longer than the time for electrifying the motor M with the electrifying current in the first electrification mode.

In the above-described embodiment, a case where the second electrified state is a state where the high-side switching element QH of the one arm portion A among the three sets of arm portions A is closed, and the high-side switching element QH of one of the remaining two arm portions A among the three sets of arm portions A is closed is described, but the second electrified state may be a state where only the high-side switching element QH of the one arm portion A among the three sets of arm portions A is closed. In such a case, the current may be passed through a diode provided in parallel with the high-side switching element QH of the one of the arm portions A.

In the above-described embodiment, a case where the fourth electrified state is a state where the high-side switching element QH of the one arm portion A among the three sets of arm portions A is closed, and the high-side switching element QH of the other one of the remaining two arm portions A among the three sets of arm portions A is closed is described, but the fourth electrified state may be a state where only the high-side switching element QH of the one arm portion A among the three sets of arm portions A is closed. In such a case, the current may be passed through a diode provided in parallel with the high-side switching element QH of the other one of the arm portions A.

In the above-described embodiment, a case where the high-side switching element QH and the low-side switching element QL are configured by using the N-MOSFET is described, but at least any one of the high-side switching element QH and the low-side switching element QL may be configured by using the P-MOSFET.

The present disclosure can be used in a valve timing controller that controls the valve opening and closing timing of the internal combustion engine by the driving force of the brushless motor.

A feature of a valve timing controller according to an aspect of this disclosure resides in that the valve timing controller includes: a driving-side rotation member that synchronously rotates with respect to a crankshaft of an internal combustion engine; a driven-side rotation member that is disposed coaxially with a rotation axis of the driving-side rotation member, and rotates integrally with a camshaft of the internal combustion engine; a phase setting mechanism that sets a relative rotation phase between the driving-side rotation member and the driven-side rotation member; a brushless motor that drives the phase setting mechanism; a control portion that controls the brushless motor by electrifying an inverter having three sets of arm portions having a high-side switching element and a low-side switching element connected to each other in series between a first power supply line and a second power supply line connected to a potential lower than a potential of the first power supply line; and a command information acquisition section that acquires holding command information indicating a command for holding a rotor of the brushless motor in a non-rotating state, in which the control portion controls the brushless motor in a first electrification mode including a first electrified state and a second electrified state, in a case where the command information acquisition section acquires the holding command information, the first electrified state is a state where both the high-side switching element of one arm portion among the three sets of arm portions and the low-side switching element of any one of the remaining two arm portions among the three sets of arm portions are closed, and the second electrified state is a state where the high-side switching element of the one arm portion among the three sets of arm portions is closed.

With such a characteristic configuration, in a case where there is a command for holding the rotor of the brushless motor in a non-rotating state, the control portion controls the brushless motor in the first electrification mode, and thus, even when the brushless motor is locked, it is possible to suppress the current flowing through the switching element of the inverter or the coil of the brushless motor, and to suppress the heat generation. In other words, in a case where a current is passed through only a specific one phase in the three-phase brushless motor, the heat generation becomes large, but it is possible to suppress the heat generation by passing a current through the other one phase. Therefore, according to the valve timing controller, while suppressing the deterioration or damage of the element, it is possible to hold the relative rotation phase between the driving-side rotation member and the driven-side rotation member to be a predetermined relative rotation phase (for example, most retarded angle phase).

The control portion may switch from the first electrification mode to a second electrification mode including a third electrified state and a fourth electrified state to control the brushless motor, in a case where a preset switching condition is satisfied, the third electrified state may be a state where both the high-side switching element of the one arm portion among the three sets of arm portions and the low-side switching element of the other one of the remaining two arm portions among the three sets of arm portions are closed, and the fourth electrified state may be a state where the high-side switching element of the one arm portion among the three sets of arm portions is closed.

With such a configuration, in a case where a preset switching condition is satisfied, the control portion switches from the first electrification mode to the second electrification mode to control the brushless motor, and thus, it is possible to change the heat generation situation of the element in a state where the brushless motor is locked.

The valve timing controller may further include a temperature detecting section that detects an ambient temperature of at least one of the inverter, a coil of the brushless motor, and the brushless motor, and the control portion may switch to the second electrification mode to control the brushless motor, in a case where the ambient temperature exceeds a preset temperature during the control of the brushless motor according to the first electrification mode.

With such a configuration, in a case where the ambient temperature of at least one of the inverter, the coil of the brushless motor, and the brushless motor exceeds a preset temperature, it is possible to change the heat generation situation of the element.

The valve timing controller may further include a map storage section that stores a temperature estimation map for estimating a temperature of at least one of the inverter, the coil of the brushless motor, and the brushless motor, which is defined by a current value of an electrifying current for the brushless motor and a time for electrifying the brushless motor with the electrifying current, and the control portion may switch between the first electrification mode and the second electrification mode based on the temperature estimation map to control the brushless motor.

With such a configuration, for example, in a case where the estimated temperature of at least one of the inverter, the coil of the brushless motor, and the brushless motor reaches a preset temperature, it is possible to change the heat generation situation of the element.

An electrifying current that electrifies the brushless motor in the second electrification mode may be larger than an electrifying current that electrifies the brushless motor in the first electrification mode, and a time for electrifying the brushless motor with the electrifying current in the second electrification mode may be shorter than a time for electrifying the brushless motor with the electrifying current in the first electrification mode.

In a case where a force generated when a current is passed through one phase, which is optimum for keeping the relative rotation phase of the valve timing controller at the most retarded angle, is generated to be equivalent to a force generated for the other non-optimal phase, a current with a current value larger than the current value of the current passing through the optimum one phase must be passed through the other one phase. According to the above-described configuration, the current value of the current passing through the other one phase is large, but the electrification time for the other one phase can be shorter than the electrification time for the optimum one phase. Therefore, it is possible to suppress the current passing through the switching element of the inverter and the coil of the brushless motor, and to optimally manage the temperature of the brushless motor.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve timing controller comprising:

a driving-side rotation member that synchronously rotates with respect to a crankshaft of an internal combustion engine;

a driven-side rotation member disposed coaxially with a rotation axis of the driving-side rotation member, and rotates integrally with a camshaft of the internal combustion engine;

a phase setting mechanism that sets a relative rotation phase between the driving-side rotation member and the driven-side rotation member;

a brushless motor that drives the phase setting mechanism;

a control portion that controls the brushless motor by electrifying an inverter including a first arm portion, a second arm portion, and a third arm portion, each arm portion having a high-side switching element and a low-side switching element connected to each other in series between a first power supply line and a second power supply line, a potential of the second power supply line being lower than a potential of the first power supply line; and a command information acquisition section that acquires holding command information indicating a command for holding a rotor of the brushless motor in a non-rotating state, wherein;

the control portion controls the brushless motor in a first electrification mode including a first electrified state and a second electrified state when the command information acquisition section acquires the holding command information, in the first electrified state, the high-side switching element of the first arm portion and the low-side switching element of one of the second or third arm portions are closed, and in the second electrified state, the high-side switching element of the first arm portion is closed.

2. The valve timing controller according to claim 1, wherein:

when a preset switching condition is satisfied, the control portion switches from the first electrification mode to a second electrification mode including a third electrified state and a fourth electrified state, in the third electrified state, the high-side switching element of the first arm portion and the low-side switching element of a remaining one of the second or third arm portions are closed, and in the fourth electrified state, the high-side switching element of the first arm portion is closed.

3. The valve timing controller according to claim 2, further comprising:

a temperature detecting section that detects an ambient temperature of at least one of the inverter, a coil of the brushless motor, and the brushless motor, wherein the control portion switches from the first electrification mode to the second electrification mode when the ambient temperature exceeds a preset temperature.

4. The valve timing controller according to claim 2, further comprising:

a map storage section that stores a temperature estimation map for estimating a temperature of at least one of the inverter, a coil of the brushless motor, and the brushless motor, the temperature being estimated based on a current value of an electrifying current of the brushless motor and a duration of the electrifying current, wherein the control portion switches between the first electrification mode and the second electrification mode based on the estimated temperature.

5. The valve timing controller according to claim 2, wherein:

a first electrifying current that electrifies the brushless motor in the first electrification mode is less than a second electrifying current that electrifies the brushless motor in the second electrification mode, and a duration of the first electrifying current is greater than a duration of the second electrifying current.

* * * * *